US008317952B2

(12) United States Patent
Katzakian et al.

(10) Patent No.: US 8,317,952 B2
(45) Date of Patent: Nov. 27, 2012

(54) HIGH PERFORMANCE ELECTRICALLY CONTROLLED SOLUTION SOLID PROPELLANT

(75) Inventors: Arthur Katzakian, Elk Grove, CA (US); Charles Grix, Gold River, CA (US)

(73) Assignee: Digital Solid State Propulsion, LLC, Reno, NV (US)

( * ) Notice: Subject to any disclaimer, the term of this patent is extended or adjusted under 35 U.S.C. 154(b) by 1604 days.

(21) Appl. No.: 11/787,001

(22) Filed: Apr. 13, 2007

(65) Prior Publication Data

US 2012/0103479 A1 May 3, 2012

Related U.S. Application Data

(60) Provisional application No. 60/792,052, filed on Apr. 13, 2006.

(51) Int. Cl.

| | |
|---|---|
| ***C06B 45/00*** | (2006.01) |
| ***C06B 45/04*** | (2006.01) |
| ***C06B 31/00*** | (2006.01) |
| ***D03D 23/00*** | (2006.01) |
| ***D03D 43/00*** | (2006.01) |

(52) U.S. Cl. ..... 149/19.1; 149/2; 149/17; 149/45; 149/109.2; 149/109.4

(58) Field of Classification Search ..... 149/2, 17, 149/45, 109.2, 109.4, 19.1
See application file for complete search history.

(56) References Cited

U.S. PATENT DOCUMENTS

| | | | | |
|---|---|---|---|---|
| 2,937,830 | A * | 5/1960 | Fulton | 244/122 AD |
| 6,354,218 | B1 * | 3/2002 | Weise et al. | 102/286 |
| 2006/0011276 | A1 * | 1/2006 | Grix et al. | 149/1 |
| 2011/0067789 | A1 * | 3/2011 | Grix et al. | 149/19.1 |

* cited by examiner

*Primary Examiner* — James McDonough
(74) *Attorney, Agent, or Firm* — Temmerman Law Office; Mathew J. Temmerman

(57) ABSTRACT

The present invention is an electrically controlled propellant comprising a binder, an oxidizer, and a cross-linking agent. The boric acid (the cross-linking agent) has been found to function as a cross-linking agent for the high molecular binder used to make the propellant, thereby improving the composition's ability to withstand combustion without melting. The present invention also may include 5-aminotetrazole (5-ATZ) as a stability-enhancing additive. The binder of the present invention may include polyvinylalcohol (PVA) and/or the co-polymer of polyvinylalcohol/polyvinylamine nitrate (PVA/PVAN).

7 Claims, 4 Drawing Sheets

HIGH PERFORMANCE ELECTRICALLY CONTROLLED SOLUTION SOLID PROPELLANT

RELATED INVENTIONS

This invention claims priority from the provisional application with Ser. No. 60/792,052, which was filed on Apr. 13, 2006. The disclosure of that provisional application is incorporated herein by reference as if set out in full.

BACKGROUND OF THE INVENTION

1. Field of the Invention

This invention is related to electrically controlled propellants.

2. General Background

For a number of applications, it is desirable to control the ignition, burn rate, and extinguishment of a propellant by the application of an electrical current. For instance, orbital attitude control rockets typically fire in short, controlled bursts to incrementally adjust the satellite's position. In these instances, an electrically controlled propellant may very precisely control the duration and burn rate of the rocket.

In the past, Teflon and other substances have been used as electrically controlled propellants, but these propellants suffer from two significant drawbacks. First, they often do not extinguish as quickly as desired after the electrical current has stopped. Hence precision and accuracy of the burn and therefore of the rocket is diminished. Second, these propellants provide none of their own energy, since all the energy for propellant gas generation comes from the electrical energy source.

Therefore, a new electrically controlled propellant has been developed, as described in U.S. patent application Ser. No. 10/136,786 and 10/423,072, the disclosure of which is incorporated herein as if set out in full. The electrically controlled propellant in the '786 and the '072 patents comprise an ionomeric oxidizer binder, an oxidizer mix including at least one oxidizer salt and at least one eutectic material that maintains the mix in a liquid form at the processing temperature and a mobile phase which may include at least one polar protic high boiling organic liquid.

The '786 and '072 electrically controlled propellants require the application of electrical voltage to initiate and sustain combustion, but the energy released is potentially much greater than the energy supplied. Using the combustion exhaust it may be possible to generate sufficient electrical energy by magnetohydrodynamics (magnetofluiddynamics or hydromagnetic) to sustain and control combustion once the propellant is ignited. Such a propellant system could also find useful application for "on demand" reusable gas generators and a controllable gas generator for automobile air bags.

However, the electrically controlled propellant disclosed in the '786 patent has drawbacks of its own. Under certain circumstances it can melt or soften during combustion, thereby decreasing its effectiveness. More particularly, melting can undermine the ability of the propellant to be used in situations where the propellant must be ignited and extinguished multiple times. In addition, the fluid phase of the propellants in this application has sufficient volatility to slowly evaporate from the surface of the propellant, making its application not suitable for use in the vacuum of space.

OBJECTIVES

Therefore, the Applicants have refined and reformulated the propellant, overcoming the problems with melting and simultaneously achieving new objectives which will be described in this application.

A first objective of the present invention is to create an electrically controlled propellant with the desirable characteristics that it be processable and curable at or near room temperature.

A second objective of the present invention is to present an electrically controlled propellant that has an electrical conductivity at its combustion surface that is significantly higher than that of the body of the propellant.

A third objective of the present invention is to increase rocket thruster life and decrease rocket thruster mass.

A fourth objective of the present invention is present an electrically controlled propellant that has a low energy threshold for ignition of the propellant and for maintaining of combustion, while still retaining exteinguishment properties.

A fifth objective of the present invention is present an electrically controlled propellant that is highly electrically and stable conductive over a wide temperature range while still retaining extinguishment properties.

A sixth objective of the present invention is to present an electrically controlled propellant that avoids liquefaction during combustion.

SUMMARY OF THE INVENTION

The present invention is an electrically controlled, propellant comprising a binder, an oxidizer, and a cross-linking agent. The propellant can be ignited by applying electrical voltage and can be extinguished by withdrawing electrical voltage. A cross-linking agent comprising boric acid has been found to function as a cross-linking agent for the high molecular binder used to make the propellant, thereby improving the composition's ability to withstand combustion without melting. The present invention also may include 5-aminotetrazole (5-ATZ) as a stability-enhancing additive. The binder of the present invention may include polyvinylalcohol (PVA) and/or the co-polymer of polyvinylalcohol/polyvinylamine nitrate (PVA/PVAN).

DETAILED DESCRIPTION OF THE INVENTION

The present invention is an electrically controlled, propellant comprising a binder, an oxidizer, and a boric acid cross-linking agent. The propellant can be ignited by applying electrical voltage and can be extinguished by withdrawing electrical voltage. A cross-linking agent comprising boric acid has been found to function as a cross-linking agent for the high molecular binder used to make the propellant, thereby improving the composition's ability to withstand combustion without melting. The present invention also may include 5-aminotetrazole (5-ATZ) as a stability-enhancing additive. The binder of the present invention may include polyvinylalcohol (PVA) and/or the co-polymer of polyvinylalcohol/polyvinylamine nitrate (PVA/PVAN).

Applicant has recently discovered that the previously disclosed electrically controlled propellant can be further enhanced through the use of boric acid as an agent to promote cross-linking in the finished propellant. The composition can be further enhanced through the addition of 5-ATZ. Finally, through the use of a new copolymer of PVA/PVAN, the use of HAN/AN mixtures having low freezing points was permitted. The new copolymer must first be enhanced by reaction with a low molecular weight difunctional epoxy compound; otherwise it will exhibit poor mechanical properties.

Boric Acid as Cross-Linking agent. Initially Applicant used conventional commercially available PVA to produce propellant with HAN oxidizer. However, during combustion the propellant just below the burning surface turned liquid. This is not desirable for an electrically controlled propellant. This problem was solved when it was discovered that the addition of a small amount of boric acid to the propellant actually promoted cross-linking of the PVA, preventing the propellant from turning liquid during combustion. This cross-linking process proved to be highly compatible with propellant processing and casting requirements. Two test samples were made to compare the effect on modulus using boric acid as a cross-linking agent. The two formulations made and measured are shown in Table 1 below:

TABLE 1

Formulations made with and without Boric Acid

| Material | Control Weight % | Cross-Linked Weight % |
|---|---|---|
| sHAN-5* | 85.00 | 83.75 |
| PVA | 15.00 | 14.25 |
| Boric Acid | — | 2.00 |
| Totals: | 100.00 | 100.00 |

Figure 1:
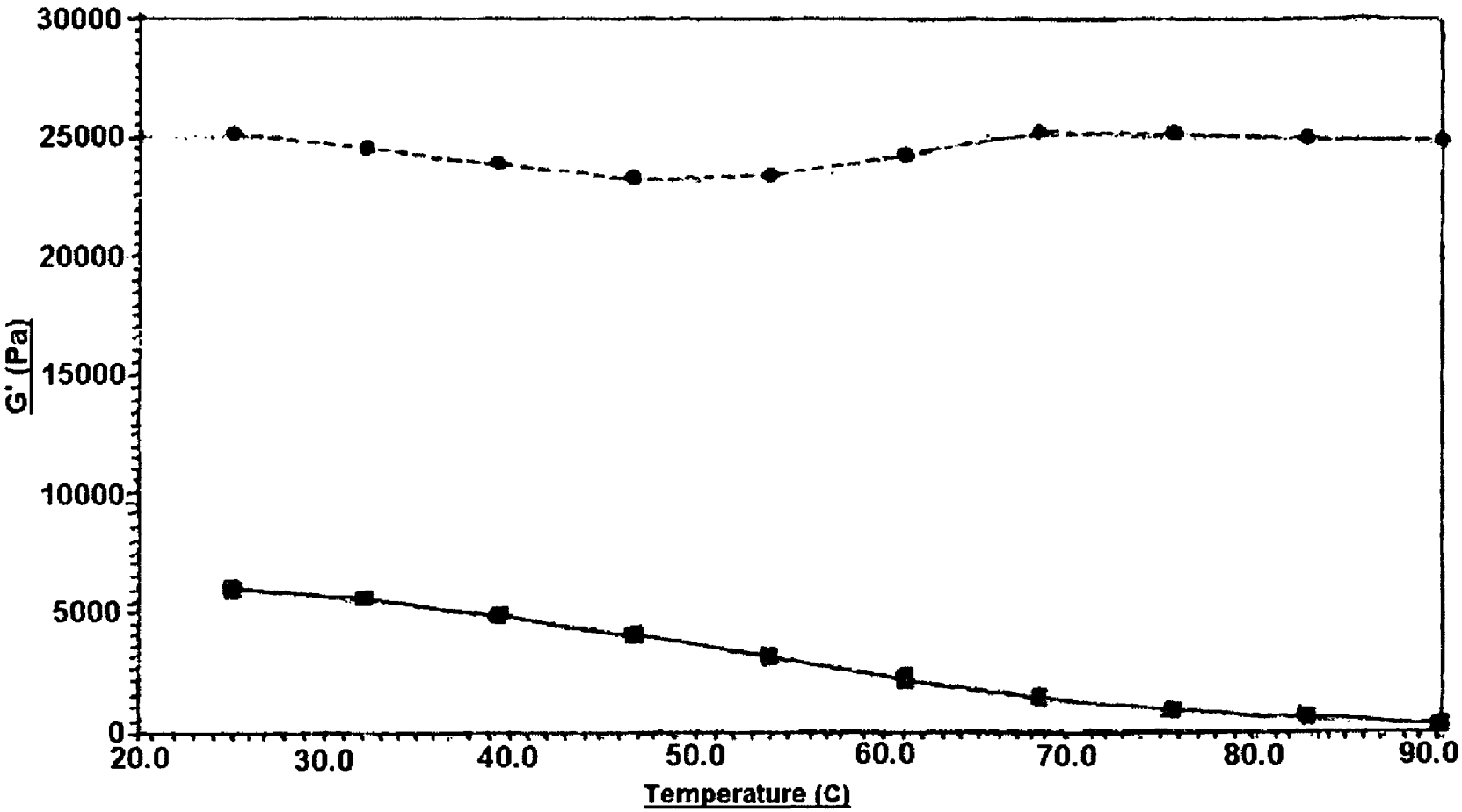
FIG. 1 is a chart with torsional modulii of HAN/PVA/PVAN based propellants on the Y axis measured as a function of temperature on the X axis. Circular data points (having a high torsional modulus) represent propellants with Boric Acid while rectangular data points represent propellants without Boric Acid.

*HAN/AN, 95/5 by wt., stabilized with dipyridyl and ammonium dihydrogen phosphate The propellants were cast into silicon rubber molds measuring 1"×2"×⅛". The samples were cured for 24 hours at 30 degrees C. The oven temperature was then raised to 50 degrees C. and the samples were allowed to postcure for 5 days. Round discs 1" in diameter were pressed from the samples. The relative torsional modulii of these two samples were measured as a function of temperature. See FIG. 1. It can be seen that the modulus increased by over a factor of four at 25 degrees C. The modulus of the cross-linked sample showed a moderate decrease in modulus with increasing temperature up to 60 degrees C., after which it increased to the modulus initially measured at 25 degrees C. Continuing to increase the temperature, the modulus stays virtually constant to 90 degrees C. It is obvious that the sample had not completed its post cure. By contrast, the modulus of the control sample began dropping with increasing temperature. At 90 degrees C. the modulus was less than 7% of its 25 degrees C. value. Thus, it was clear to the Applicant that the boric acid substantially increases the propellant modulus and maintains that modulus to 90 degrees C. It is expected, but was not substantiated, that had the cross-linked sample been cooled to 25 degrees C. and its modulus measured, it would have been much higher. The end result is that the cross-linked propellant will not exhibit a tendency to slump or creep in large grains. This is a requirement for reasonably large solid rocket motors.

However, experiments conducted with HAN/PVA propellants cross-linked with boric acid indicated that the electrical conductivity of this propellant was too high. Because there was very low resistance, the current flow was not strictly confined to the propellant surface, but penetrated into the body of the propellant, thereby making combustion at the surface difficult. Combustion appeared to only occur at the electrodes where the current density was sufficiently high.

Increased Molecular Weight with a Diepoxide Resin. The inventors also discovered that the molecular weight of a commercially available PVA/PVAm copolymer from ERKOL could be increased by a factor of 6 to 8 times using a low molecular weight diepoxide resin to link the polymer chains through the pendant primary amine groups. This high molecular weight polymer was isolated as the nitrate salt of its polyamine component. Substituting it for the PVA binder, it was possible to make a propellant using a HAN-based oxidizer with a high level of AN. With the addition of boric acid, a firm non-melting propellant was produced whose mechanical properties, though still a somewhat brittle propellant, were sufficient for this application. However, upon extended curing at an elevated temperature (4-5 days at 50° C.) the propellant lost its brittleness to form a tough rubbery mass.

Work continued on preparing the PVA/PVAN copolymer of high molecular weight so that substantial amounts of AN could be formulated into the propellant along with the HAN to effectively reduce the propellant electrical conductivity. Because HAN does not form homogeneous liquid mixtures with high levels of AN, when the AN level exceeds 25% of the HAN oxidizer, additional AN remains as a granular solid. Increase of the granular level of AN results in a decrease in that portion of the HAN/AN that is liquid and, thereby, reduces the electrical conductivity of the propellant. Attempts to prepare propellants with a large excess of AN using the high molecular weight PVAN polymer failed to produce propellants with desired mechanical properties, but succeeded in producing a less electrically conductive propellant.

Propellants were also prepared with HAN and PVA using boric acid to cross-link the polymer. This produced a highly electrically conductive propellant which would only burn where the electrodes contacted the propellant and not along the surface gap between electrodes when using an electrode gap greater that ¼". An attempt was made to overcome this problem by bonding a dielectric film in the propellant such that the film did not extend to the surface of the propellant to be burned. The purpose was to force the current to flow along the propellant surface because the gap between the electrodes and the film was less than ⅛". This did not work well, but the problem appeared to have been resolved by limiting the gap between the electrodes to ⅛" or less. The propellant extinguished immediately when the current was turned off.

An aging program test was prepared and three propellant formulations were selected for it. The first was based on HAN/AN/PVA/Boric acid, the second was based on HAN/AN/SN/PVA/Boric acid and the third was based on HAN/AN/PVA/PVAN/Boric acid. Sufficient propellant was prepared of each formulation to prepare sufficient samples to conduct aging at 35° C. and 50° C. for five (5) months. Testing of the aging samples included DSC, TGA, Torsional Modulus, Resistivity measurement and Electrically controlled testing. The aging program was initiated and completed. The aging results were very good on the HAN-5/PVA/boric acid propellant. Little or no adverse change in properties was shown at the end of the program. The aging samples containing sodium nitrate, however, began to exhibit decomposition, particularly the 50° C. aging samples. Also, the sodium nitrate containing samples did not extinguish very well. They continued to undergo low level burning after the current was turned off. The sodium nitrate containing propellant also was found to exhibit visible aging changes at 50° C., interfere with propellant extinguishment and cause the propellant to harden significantly more than the other two propellants that contained no sodium nitrate. The aging samples made with the modified copolymer from ERKOL appeared to be aging well and showed very good ignition and extinguishment properties, but suffered from having marginal mechanical properties. Also, all three of the propellants experienced an increase in Torsional modulus in the first few weeks of the aging program, which was attributed to postcuring. No significant changes in thermal stability properties were observed. The combustion testing indicated that propellant formulation #3 produced the best combustion characteristics, but had the poorest mechanical properties. None of these propellants exhibited good combustion characteristics on the initial testing, however, the combustion properties of the propellants improved with aging. This was probably related to the increased Torsional modulus observed by all three formulations during aging. In order to make this propellant undergo electrically controlled combustion, it was necessary to gap the electrodes at ⅛" or less to minimize conduction of electricity below the propellant surface.

During the aging program additional efforts were made to improve the propellants made with the PVA/PVAN copolymer. Two copolymers of polyvinylalcohol/polyvinylamine (PVA/PVAm), one a pilot material and the other, specially prepared and similar to that received from ERKOL but significantly higher in molecular weight, were acquired from Mitsubishi Chemical and converted to the copolymer polyvinylalcohol/polyvinylamine nitrate (PVA/PVAN) by neutralization with nitric acid. The molecular weight of the pilot material was ~117,000 and for the specially prepared material was ~170,000. These polymers were evaluated in formulations with HAN containing fairly high amounts of ammonium nitrate to significantly suppress the freezing point of the HAN. The higher molecular weight copolymer produced propellant that was better than the ERKOL product similarly converted, but not as good as the propellant made with PVA using HAN-5 (HAN containing 5% AN). The copolymer was, however, quite able to swell and cure with the HAN having the high levels of AN (>5%).

Finally, a new additive was evaluated, 5-aminotetrazole (5-ATZ), and was found to increase the decomposition temperature of the HAN-based propellant by at least 20° C. This additive also appeared to improve the combustion characteristics of propellant formulation #1 in the aging study. The amphoteric nature of 5-ATZ and its ability to complex heavy metals are believed to be responsible for these improved properties. Propellant test samples were prepared and provided to the AFRL Electric Propulsion Section personnel for their in-house testing program.

Hydroxylamine nitrate (HAN) was the main oxidizer utilized in this program. Various formulations incorporating the co-oxidizers AN and HN were also evaluated. Hydrazine nitrate, Polyvinylamine nitrate (PVAN) and N-butylpyridinium nitrate (NBPN) were prepared from the starting reagents hydrazine, vinylformamide and N,n-butylpyridinium hydrochloride, respectively.

PVAN was prepared as follows to provide material for later conversion to a vinyl-functional PVAN via reaction with 1,2-epoxy-5-hexene: A one thousand gram quantity of 4.5% very high molecular weight polyvinylformamide (~3.5 M molecular weight) received from BASF Corporation was hydrolyzed in a 2 liter resin pot to the corresponding polyvinylamine by combining it with a solution of 29 grams of sodium hydroxide in 250 ml of distilled water and heating it to 80° C. with stirring and holding it at that temperature for 8 hours. Two hundred grams of this solution were combined with 200 ml distilled water and 60 ml of 4 N nitric acid were added drop wise to this solution while it was being vigorously stirred. The colorless polyvinyl amine nitrate (PVAN) precipitated as the nitric acid was being added. The precipitate was granular, but formed an agglomerate after the water was removed and methanol was added. The PVAN was kept under methanol for 1 hour and then the mixture was transferred to a stainless steel blender and broken into small particles using short bursts of the blender. The particles were isolated by filtration and allowed to dry at room temperature for two hours. They were then placed into a 40° C. circulating oven overnight to completely dry out. The particles were then ground in an impact grinder until they all passed through a 140-mesh screen.

Hydrazine nitrate (HN) was prepared by reacting anhydrous hydrazine with an equivalent amount of ammonium nitrate. Formation took place by displacement of the ammonia as a gas. In production the ammonia would be scavenged by passing it through an aqueous nitric acid solution trap to form ammonium nitrate, which could then be used to prepare more HN. The HN product was purified by crystallization from methanol. This process was quite safe because it eliminated the need to neutralize the hydrazine with nitric acid. The procedure used is as follows.

To a one-liter glass beaker 520 grams (6.5 moles) of 98% ammonium nitrate and 208 grams (6.5 moles) of 98% hydrazine were added. The two materials were stirred to form a slurry and allowed to stand in a hood for 24 hours to permit the displaced ammonia to escape. The reaction mixture was then heated to 35° C. and held at that temperature for an additional 24 hours to complete the displacement of ammonia. To the crude liquid HN were added 400 ml of dry methanol and the mixture was stirred and heated to 40° C. The beaker was then transferred to a refrigerator and left overnight, during which virtually all the HN crystallized. The crystallized HN was isolated by suction filtration and washed twice with 50 ml portions of chilled methanol. The HN crystals were then dried in a 35° C. circulating oven and then stored in a dry box. Approximately 600 grams of dried product were obtained.

Four liters of stabilized HAN were prepared by neutralizing 220 liters of 18% aqueous HAN, purchased from SACHEM in Texas, with 35% aqueous nitric acid followed by the addition of 20 grams of ammonium dihydrogen phosphate and 20 grams of 2,2'-dipyridyl. The mixture was stirred until everything was in solution. Water was removed from this solution under vacuum at 50° C. on a rotary evaporator until a moisture level of 0.9% was reached as determined by Karl Fischer analysis. The Karl Fischer reagent used was pyridine based.

Vinyl Functional PVA/PVAN Prepared at Three Levels of Vinyl Content.

Experiments were conducted to investigate the feasibility of attaching vinyl functional groups onto the PVA/PVAm copolymer in order to cross-link the polymer after the propellant was prepared and cast. This was made possible because a commercial source of the starting material had been located, ERKOL, INC. ET Materials, LLC received a sample of the material, and an initial analysis indicated the amine level to be approximately 9%. This matched the material that was previously acquired from Air Products, which was no longer made. A reaction was also set up to react the amine groups with glycidyl methacrylate. The amine groups in both cases were then neutralized with nitric acid to yield the amine nitrate product. The materials were evaluated in 10-gram propellant samples.

Conversion of the polyvinyl alcohol/polyvinyl amine (90/10 mole ratio) copolymer was accomplished starting with a 200-gram sample of the copolymer as obtained from ERKOL SA, Spain. This co-polymer has a molecular weight of ~80 K. The object was to conduct the reaction without dissolving the polymer. The copolymer was ground to a powder in a stainless steel blender sufficient to pass through a 50-mesh screen. The ground material was combined with 200 ml of dry methanol in a 500 ml. Erlenmeyer flask. A magnetic stir bar was added and the mixture was stirred for 24 hours to extract any sodium acetate and sodium formate that was present from the polymerization. After extraction was complete, the polymer was isolated by suction filtration, washed twice with 50-ml portions of dry methanol and dried in a 50° C. circulating oven. One hundred ninety two grams of dried polymer were isolated, indicating 4% of the material was extracted into the methanol. In order to prepare a vinyl-adducted polymer, 22 grams (0.05 equiv.) of this material were formed into a slurry with 100 ml of dry methanol and stirred for a period of one hour at 50° C. This was followed by cooling to room temperature during a one-hour period. The purpose was to swell the polymer powder with methanol to allow the epoxy-based reactant to penetrate into the polymer particles. To this mixture were added 3.74 grams (0.055 equiv.) of 1,2-epoxy-5-hexene and the mixture was stirred for 24 hours. Although the odor of the vinyl epoxy was still discernable after this time, the mixture was filtered and washed with two 50-ml aliquots of dry methanol. The resultant product was dried at 30° C. overnight. A second run was made with 50 grams of the same ground, sieved and methanol-extracted copolymer. A solution of 175 grams methanol and 25 grams water was prepared and added to the 50 grams of polymer in a 250 ml Erlenmeyer flask. The addition of water was to enhance the swelling of the polymer, hopefully making it easier for the epoxy to react. A magnetic stir bar was added as well as 8 grams of 1,2-epoxy-5-hexene, and the resulting mixture was stirred for three days at ambient temperature. As before, the smell of the vinyl epoxy was still evident. This product was isolated as described above.

Using the procedure described above, except that glycidyl methacrylate was substituted for 1,2-epoxy-5-hexene, an acrylate functional copolymer was prepared. The reaction seemed to proceed well, but it was not possible to follow the reaction by titration of the unreacted epoxy.

The commercially available copolymer of PVA and PVAm has a weight average molecular weight of ~80,000. However, this is not adequate for preparing these plastisol type propellants. Unfortunately, it is very difficult to prepare this copolymer in sufficiently high molecular weight to be useful. An alternative route to such a high molecular weight polymer was devised which involved dissolving the polymer in a methanol/water mixture and then reacting it with a low molecular weight diepoxide resin. Following reaction, the solution was neutralized to a pH between 1 and 2 with 35% nitric acid, followed by precipitation of the resulting polymer with the addition of IPA while stirring. A small run was conducted as follows: Ten grams of PVA/PVAm, 88/12, were dissolved in 200 ml of a 35/65 mixture of methanol/water by volume. Once the polymer was dissolved, 0.5 grams of 1,3-butadiene dioxide (BDDE), dissolved in 5 ml of methanol were added to the polymer solution. The mixture was stirred at room temperature for 48 hours to assure reaction. The reaction mixture was then neutralized to a pH between 1 and 2 with 35% aqueous nitric acid. The resulting PVA/PVAN polymer was isolated by slowly adding 1 liter of IPA to the reaction mixture while continuously stirring. The precipitated polymer was isolated by suction filtration, washed with 25 ml of dry methanol and dried in a 40° C. circulating oven to ~10% water. It was then place in a 50° C. vacuum oven and placed under vacuum for 24 hours. The polymer expanded into a porous structure and became dry. It was easily broken into small pieces and ground to a fine powder in a mill.

In order to evaluate the change in molecular weight of the produced polymer, one gram of the as-received PVA/PVAm whose amine groups had been converted to the nitrate salt was dissolved in 100 ml of distilled water. In similar fashion one gram of the high molecular weight version of this polymer was dissolved in 100 ml distilled water. The latter solution turned to a gel, which was indicative of a high molecular weight polymer. The one percent low molecular weight polymer solution exhibited a low viscosity as measured on a TA Instruments AR1000 Rheometer. The results of these viscosity measurements are presented in table 2:

TABLE 2

Comparison of Viscosities of Low and High Molecular Weight PVA/PVAN Copolymers.

| Copolymer | Viscosity, Pascal seconds |
|---|---|
| Low MW | 140 |
| High MW | 850 |

These results indicated a minimum increase in molecular weight of six times over the control, since the increase in viscosity is proportional to the increase in molecular weight. Because the molecular weight of the starting polymer is ~80,000, the final polymer would be expected to have a molecular weight of at least ~500,000. In reality, this ratio only holds for linear polymers. Branched polymers have to increase their molecular weight more to produce the same viscosity, since the high molecular weight polymer was expected to be branched by virtue of the manner in which the molecular weight was increased. The molecular weight is expected to actually be in the vicinity of 600,000 to 700,000.

An alternative approach to converting the moderate molecular weight PVA/PVAm copolymer from ERKOL to a high molecular weight copolymer was devised. Instead of dissolving the PVA/PVAm in a water/methanol mixture, the finely divided copolymer was slurried in methanol that contained 5% water. The BDDE was then added as a methanol solution and the reaction was conducted at room temperature for two days with continuous stirring. In this way the polymer was not put into solution and was, therefore, easily isolated. Reaction completion was determined by testing the liquid phase for epoxide. This was accomplished by reaction of the unreacted epoxide with hydrochloric acid. A typical run was conducted as follows: Twenty grams of -100 mesh PVA/PVAm copolymer from ERKOL were combined with a mixture of 95 ml methanol and 5 ml distilled water in a 500 ml beaker. A stirrer was added and a solution of 0.4 grams of BDDE in 10 ml of methanol were mixed in. The mixture was stirred overnight at room temperature and then filtered to collect the polymer. The polymer was then dried overnight in a 50° C. circulating oven. Three such runs were made, varying the epoxide/copolymer ratio. This approach does not appear to produce as high a molecular weight polymer as did the experiment that was conducted totally in solution. Also, this slurry approach appeared to produce some cross-linked polymer, which compromised the final propellant properties. Its main advantage is that the process is easier for the slurry approach.

The conversion of medium molecular weight PVA/PVAN copolymer to much higher molecular weight copolymer by reaction of a methanol slurry of finely divided PVA/PVAm copolymer with butadiene diepoxide initially proved not to be beneficial in producing a material that was compatible with HAN containing large amounts of AN. When this reaction was run as a solution instead of as a slurry, the results appeared to be better. However, running the reaction in solution was more difficult and used larger amounts of alcohol. In spite of the difficulty involved in running the solution reaction, the reaction was repeated to see if the desired product could be reproduced. Five levels of BDDE were evaluated. The reactions were conducted as follows: Into a two-liter beaker were added 900 ml of distilled water and a magnetic stir bar. Stirring was begun and 100 grams of ERKOL medium molecular weight PVA/PVAm were slowly added. When addition was complete the mixture was heated to 50° C. Upon reaching temperature, an additional 100 ml of distilled water was slowly added to the mixture. Heating and stirring were continued for ~4 hours to totally dissolve the copolymer. At this point 200 ml of the solution were transferred into each of five 500 ml plastic beakers. Into each of five 100 ml plastic beakers were placed 50 ml of methanol. In beaker 190 1 were weighed 0.1 grams of BDDE. In beaker #2 were weighed 0.2 grams of BDDE. Likewise, to beakers 3, 4, and 5 were added 0.3, 0.4 and 0.5 grams BDDE, respectively. These five solutions were covered with Saran wrap and allowed to stand at room temperature for two days. At the end of that time all five solutions had formed gels. In order to break the gels, 100 ml of distilled water were added to each beaker and stirred until uniform. Each of these solutions was neutralized to a pH of 3 by the addition of 35% aqueous nitric acid while they were being stirred. They were then poured into shallow polyethylene trays and placed in a 50° C. oven to evaporate. When the polymers were dry they were ground to a sieve size of -100 meshes to the inch. These polymers were evaluated in propellant formulations.

Work continued to convert the medium molecular weight PVA/PVAm copolymer from ERKOL to a much higher molecular weight without introducing too many chemical cross links. The method used was one that was used with some success earlier in this program. This involved preparing a slurry of the ERKOL PVA/PVAm polymer powder (-140 meshes to the inch) in methanol containing 5% water. A methanolic solution of BDDE was prepared and added to the polymer slurry with stirring. Stirring was continued for 24 hours while the mixture was maintained at 20° C. After the 24 hours were up, the temperature of the mix was raised to 50° C. and was held at that temperature for six hours while continuously being stirred. The reaction mixture was cooled to room temperature and the amine portion of the polymer was neutralized with 35% nitric acid. The resulting neutralized polymeric product was collected by suction filtration and washed with dry methanol. The isolated polymer was dried in a 50° C. circulating oven until no further weight change was observed.

Two polyvinylalcohol/polyvinylamine (PVA/PVAm) copolymer samples were received from Mitsubishi Chemical. One was a standard pilot material having an average molecular weight of ~117,000 and the other, that was specially made, has a weight average molecular weight of ~170,000. This contrasted to the ~80,000 molecular weight PVA/PVAm from ERKOL. All these copolymers have approximately 12% PVAm. The polyvinylamine portion of the 117,000 molecular weight Mitsubishi copolymer was converted to the nitrate salt by slurrying it in methanol followed by neutralization with 70% aqueous nitric acid. The neutralized copolymer was isolated by suction filtration, washed with methanol, dried in a 50° C. oven and ground to a fine powder in a mill. This material was used as a replacement for PVA in propellant formulation #1 used in the aging program, along with a change in the oxidizer from S HAN-5 to S HAN 20 (20% AN). The S HAN-20 has a much lower melting point then the S HAN-5, but will not swell into the PVA. However, in this case, the S HAN-20 had no difficulty in swelling into the copolymer to cure the propellant. This cured propellant was closer in properties to the formulation #1 used in the aging study and better than formulation #3, also used in the aging study, that was prepared with a less effectively enhanced PVA/PVAN copolymer.

Preparation of Cross-Linked PVAN.

High molecular weight (~2 MMW) cross-linked PVAN was prepared by reacting it with butadiene diepoxide (BDDE) in a slurry with methanol. The purpose was to prepare a material that had sufficient of its own oxygen so as not to appreciably affect the oxygen balance of the propellant and would swell somewhat with the HAN-based oxidizer. This material would permit a significantly lower level of the HAN-based liquid oxidizer to be used while not affecting the physical properties of the propellant. It would essentially behave like filler. The lower level of liquid HAN-based oxidizer would reduce the electrical conductivity of the propellant, making it more difficult for electrical current to stray from the surface of the propellant into the body when attempting to ignite it. The material was prepared as follows:

"One hundred (100) grams of ~2M MW PVAN were combined with 250 ml of methanol and 50 ml of water to form a slurry. A solution of 5 grams of BDDE in 25 ml of methanol was added to the PVAN/methanol/water slurry. The mixture was continuously stirred for 40 hours at room temperature. The cross-linked PVAN was isolated by suction filtration and washed twice with 25 ml portions of methanol. The final product was dried in a 50° C. circulating oven".

Low Melting Oxidizer Compositions.

Previous enhanced electrically controlled extinguishable solid propellant (ECESP) were prepared with AN/co-oxidizer blends rather than HAN that melted at temperatures of 125-140° C. The focus of this application is on the development of higher energy propellants that can be produced at temperatures below 60° C., and preferably at room temperature. HAN, when formulated with small amounts of co oxidizer, is a liquid at room temperature. The co-oxidizers being used are HN and/or AN. Combinations of these oxidizers can produce liquid oxidizers that remain as stable liquids as low as −20° C.

For evaluation purposes, four 100 gram samples of HAN-based oxidizer compositions (see table below) were prepared. Each of these oxidizer compositions is a liquid at room temperature and below, guaranteeing that propellants made with these oxidizers would have high electrical conductivity down to ~−20° C. This was done in part to produce compositions that freeze at temperatures well below room temperature and in part to enhance propellant hardness either by changing the solubility of the polymer being tested in the oxidizer or by providing the HN that had previously shown the ability to promote hardening of the propellant when polyacrylamide based polymers were used.

TABLE 3

HAN-Based Oxidizer Compositions*

| Formulations # | 1 | 2 | 3 | 4 |
|---|---|---|---|---|
| S-HAN** | 95 | 80 | 80 | 72 |
| AN | — | 20 | 15 | 24 |
| HN | 5 | — | 5 | 4 |

*All of these formulations were stable liquids to well below 20° C.

**Contains 0.5% ADHP, 0.5% Dipyridyl and 1.25% water

Mix HAN with Amine Nitrates and AN

Presently, ammonium nitrate and hydrazine nitrate are being used as co-oxidizers with HAN. These two compounds have been found to lower the crystallization temperature of HAN. Other amine nitrates being considered include ethanolamine nitrate (EAN), ethylenediamine dinitrate (EDDN) and sodium nitrate (SN). The intent is to find out if these materials undergo endothermic decomposition at elevated temperatures and, as such, are a part of the extinguishment characteristic of the ECESP propellant. EAN and EDDN, however, are not net oxidizers. If they are to be used, it is because they provide a valuable property to the propellant, such as improved extinguishment.

Incorporate HAN Stabilizers

Currently two stabilizers have been evaluated with HAN. The first of these, ammonium dihydrogen phosphate (ADHP), acts a buffering compound for any nitric acid generated due to HAN decomposition. The second stabilizer is 2,2'-dipyridyl which, as a base, can also neutralize any acid and is also an effective chelating agent for Iron. Currently these materials are present at 0.50% each in the oxidizer. These two HAN stabilizers have been increased to 1% each of the oxidizer formulation. Propellants were processed using the higher stabilizer levels to determine whether or not such an increase can improve thermal stability. Other potential stabilizers such as ammonium bisulfate were also evaluated without success.

Materials that Decompose Endothermically

A search of the literature for other energetic oxidizers or materials that decompose endothermically was carried out. Aside from AN and quaternary salts such as N-butylpyridinium nitrate no new compounds have been identified that decompose endothermically and are compatible with HAN. Oxalic acid, HOOCCOOH, was evaluated for its ability to generate $CO_2$, which was expected to enhance extinguishability through adiabatic expansion (Table 4). The latter appeared to work as hoped. Propellant made with oxalic acid in the formulation given below extinguished repeatedly and rapidly in combustion tests.

TABLE 4

Formulation prepared with Oxalic Acid

| | Weight % |
|---|---|
| S HAN-5 | 83.0 |
| PVA | 15.0 |
| Oxalic acid | 1.0 |
| Boric acid | 1.0 |

Formulate Propellants

The propellant formulation studies involved a variety of HAN-based oxidizer, various polymer and polymer combinations and stabilizers and extinguishment additives.

The three propellant formulations used in the aging program are given below in Table 5. These formulations are representative of each class of propellant finally decided on in this program.

TABLE 5

Selected Propellants for Aging Program

| Formulations | #1 | #2 | #3 |
|---|---|---|---|
| s-HAN 5 | 84.5 | 75.5 | — |
| s-HAN 15 | — | — | 84.5 |
| PVA (heat treated)* | 14.0 | 15.0 | — |
| PVA | 1.0 | 1.0 | — |
| PVA/PVAN (enhanced)** | — | — | 15.0 |
| SN | — | 5.0 | — |
| Boric Acid | 0.5 | 0.5 | 0.5 |

*The PVA was heated for four hours at 110° C. to increase its crystalline content, which slows down the swelling into HAN, giving increased pot life for the propellant.

**This enhanced copolymer was prepared by reacting ERKOL PVA/PVAm copolymer (medium molecular weight) with BDDE in methanol as a heterogeneous reaction.

Results of the aging tests are given in the following:

Aging DSC Tests

Figure 2:
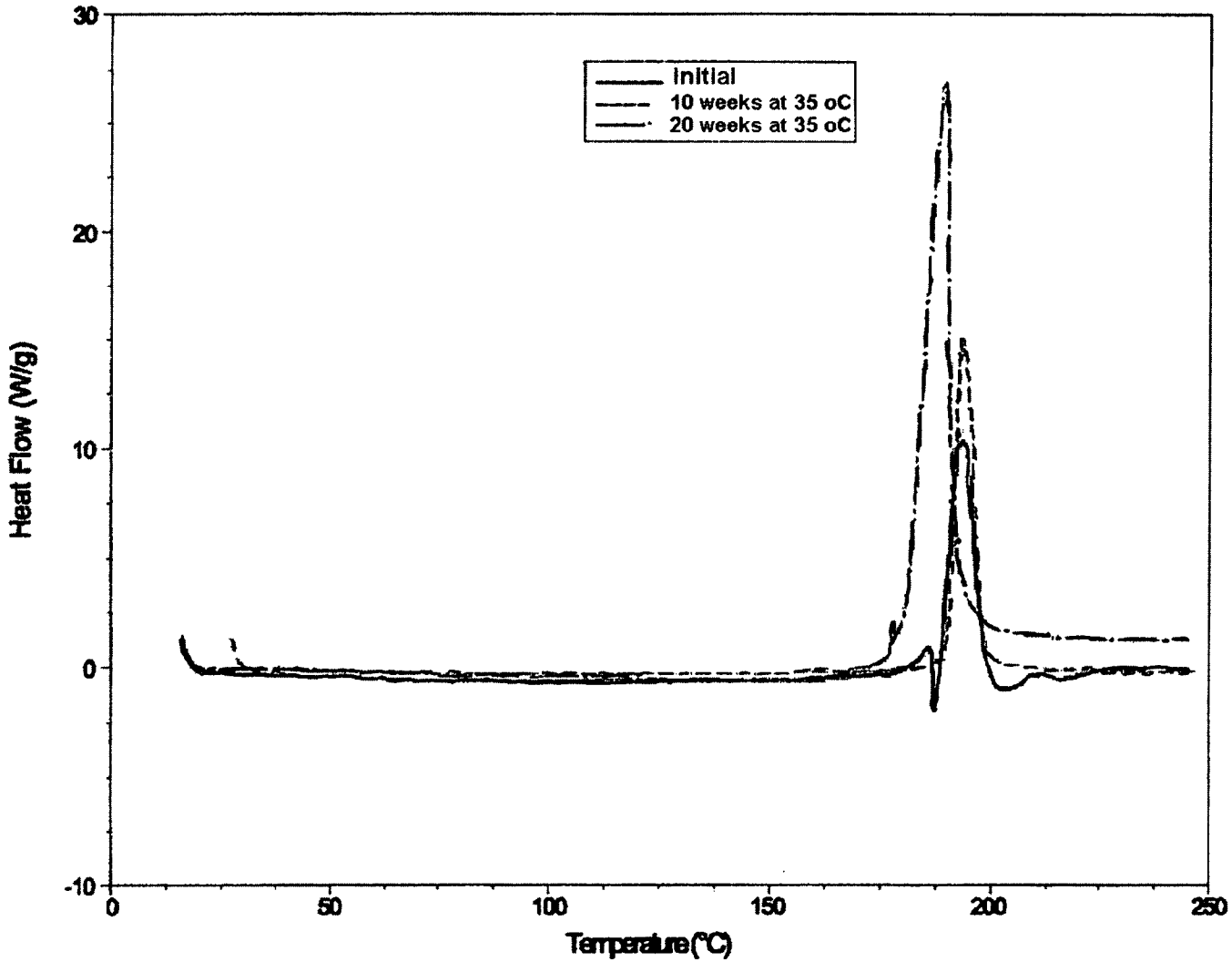
FIG. 2. DSC scans of HIPE propellant aging at 35 degrees C.
Figure 3:
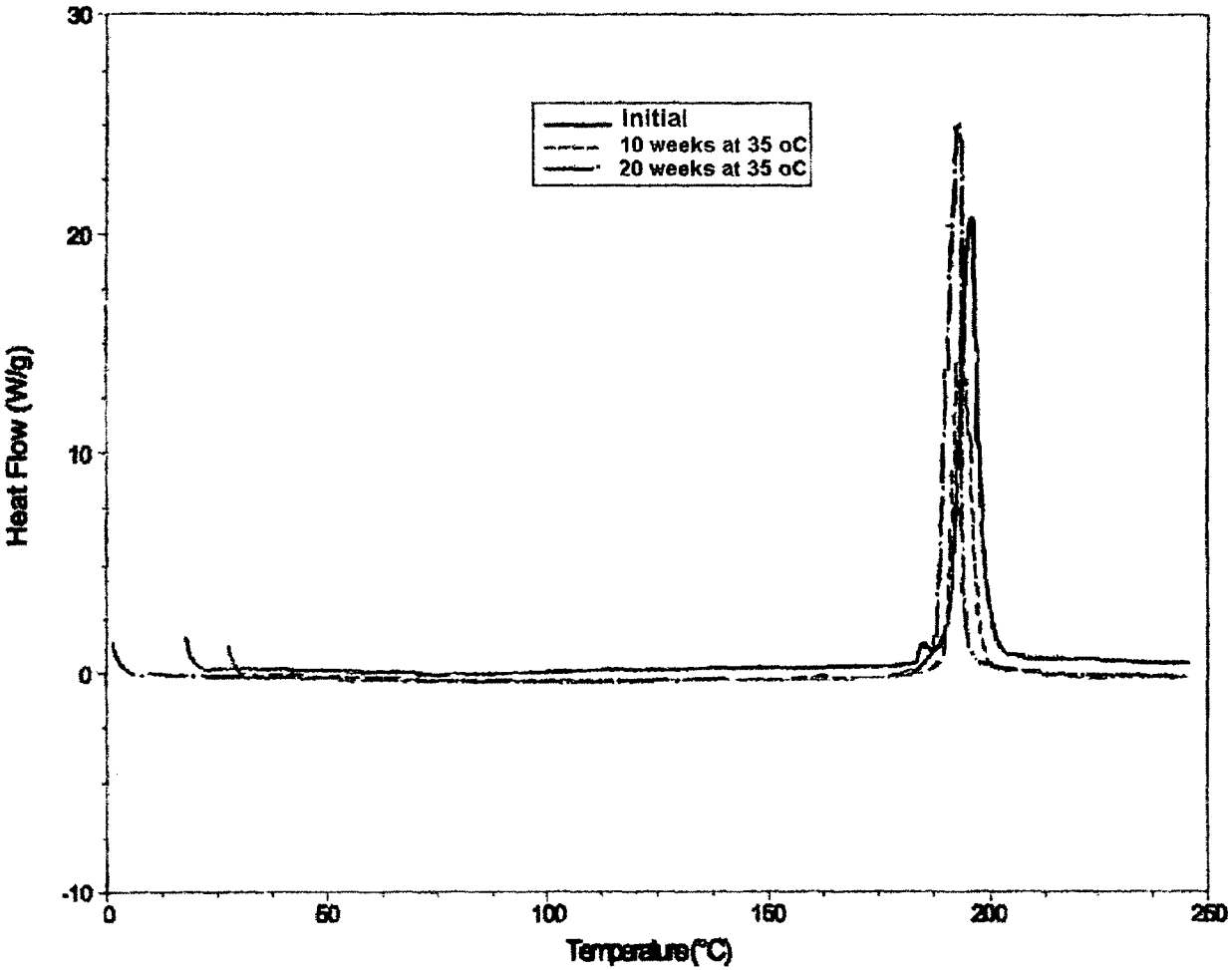
FIG. 3. DSC scans of HIPEP propellant aged at 50 degrees C.

The peak decomposition exotherm temperatures for the aging samples as measured by DSC are shown in FIGS. 2 and 3. The patterns shown for each aging interval differ little from each other. There is no indication from this test that the samples undergo significant aging change under the conditions used. Sample set #2, however, does show visible surface changes, which are not reflected in the DSC scans. Minor variations in the measurements between aging periods can be attributed to normal sampling variability and sample geometry in the test cell.

Aging TGA Tests

The aging samples have not shown any patterns of weight loss characteristics versus temperature to date. The small changes that have occurred have been random. These changes can be attributed to slight variations in the sample consistency and weight.

Aging Torsional Modulus

The aging samples shown in Table 6 generally indicate an increase in Torsional modulus. The formulation #2 samples at 50° C., however, showed a significantly larger increase than did formulations 1 and 2 at 50° C. The increase in modulus of formulation #2 parallels the observed surface changes in these samples. The other two formulations appear to have leveled off or diminished somewhat. This may be real or it might be reflecting the sleight differences in the surfaces of the samples. All the samples were tested at room temperature (~25° C.).

TABLE 6

Torsion Modulus Measurements for HPE Aging Prog.
(measurements in Pascals)

| Test Dates | Modulus (Pa) | | Modulus (Pa) | | Modulus (Pa) | | Modulus (Pa) | Modulus (Pa) | Modulus (Pa) |
|---|---|---|---|---|---|---|---|---|---|
| Week of | Sample 1O | | Sample 2O | | Sample 3O | | | | |
| Week ZERO | G' 25 c | 13,800 | G' 25 c | 7,600 | G' 25 c | 9,500 | | | |
| Initial | G' 75 c | 5,800 | G' 75 c | 3,700 | G' 75 c | 11,100 | | | |
| Control | G" 25 c | 2,200 | G" 25 c | 1,300 | G" 25 c | 1,900 | | | |
| Test | G" 75 c | 3,000 | G" 75 c | 1,300 | G" 75 c | 1,950 | | | |

TABLE 6-continued

| Torsion Modulus Measurements for HPE Aging Prog. (measurements in Pascals) | | | | | | | | | | | | |
|---|---|---|---|---|---|---|---|---|---|---|---|---|
| Test Dates | Modulus (Pa) | | Modulus (Pa) | | Modulus (Pa) | | Modulus (Pa) | | Modulus (Pa) | | Modulus (Pa) | |
| | Sample 1O 35 C. | | Sample 2O 35 C. | | Sample 3O 35 C. | | Sample 1O 50 C. | | Sample 2O 50 C. | | Sample 3O 50 C. | |
| Week 10 | G' 25 c | 15,000 | G' 25 c | 22,000 | G' 25 c | 10,500 | G' 25 c | 22,000 | G' 25 c | 55,000 | G' 25 c | 17,000 |
| | G' 75 c | 8,750 | G' 75 c | 17,500 | G' 75 c | 12,000 | G' 75 c | 18,000 | G' 75 c | 36,000 | G' 75 c | 15,100 |
| | G" 25 c | 1,250 | G" 25 c | 2,500 | G" 25 c | 1,000 | G" 25 c | 6,500 | G" 25 c | 17,500 | G" 25 c | 5,500 |
| | G" 75 c | 3,500 | G" 75 c | 7,000 | G" 75 c | 1,250 | G" 75 c | 5,000 | G" 75 c | 9,000 | G" 75 c | 3,000 |
| Week 20 | G' 25 c | 28,500 | G' 25 c | 27,250 | G' 25 c | 18,000 | G' 25 c | 18,500 | G' 25 c | 57,000 | G' 25 c | 16,950 |
| | G' 75 c | 25,500 | G' 75 c | 16,750 | G' 75 c | 19,750 | G' 75 c | 17,875 | G' 75 c | 52,000 | G' 75 c | 16,125 |
| | G" 25 c | 2,250 | G" 25 c | 2,800 | G" 25 c | 1,750 | G" 25 c | 4,500 | G" 25 c | 15,000 | G" 25 c | 4,500 |
| | G" 75 c | 3,700 | G" 75 c | 3,000 | G" 75 c | 1,750 | G" 75 c | 4,000 | G" 75 c | 8,000 | G" 75 c | 2,750 |

The aging samples have not shown any trends over time except for formulation #2 @50° C. The resistivity measurements for this sample have quadrupled over this aging period. This further attests to the deleterious effect of sodium nitrate (Table 7).

TABLE 7

| Aging Resistance and Resistivity Measurements to time (measurements in ohms) | | | | | | | | | | | | |
|---|---|---|---|---|---|---|---|---|---|---|---|---|
| Test Dates | Date & R-Values | | Date & R-Values | | Date & R-Values | | Date & R-Values | | Date & R-Values | | Date & R-Values | |
| Week: | Sample 1O | | Sample 2O | | Sample 3O | | | | | | | |
| Week zero | Week | 0 | Week | 0 | Week | 0 | | | | | | |
| Control Test | Resistance | 1.50E+01 | Resistance | 1.70E+01 | Resistance | 1.30E+01 | | | | | | |
| | Resistivity | 1.20E+02 | Resistivity | 1.36E+02 | Resistivity | 1.04E+02 | | | | | | |
| | Sample 1O 35 C. | | Sample 2O 35 C. | | Sample 3O 35 C. | | Sample 1O 50 C. | | Sample 2O 50 C. | | Sample 3O 50 C. | |
| Week 10 | Week | 10 day 2 | Week | 10 day 2 | Week | 10 day 2 | Week | 10 day 2 | Week | 10 day 2 | Week | 10 Day 2 |
| | Resistance | 1.70E+01 | Resistance | 1.40E+01 | Resistance | 1.50E+01 | Resistance | 3.20E+01 | Resistance | 3.90E+02 | Resistance | 3.40E+01 |
| | Resistivity | 1.36E+02 | Resistivity | 1.12E+02 | Resistivity | 1.20E+02 | Resistivity | 2.56E+02 | Resistivity | 3.12E+03 | Resistivity | 2.72E+02 |
| | Sample 1O 35 C. | | Sample 2O 35 C. | | Sample 3O 35 C. | | Sample 1O 50 C. | | Sample 2O 50 C. | | Sample 3O 50 C. | |
| Week 20 | Week | 20 | Week | 20 | Week | 10 day 2 | Week | 10 day 2 | Week | 10 day 2 | Week | 10 day 2 |
| | Resistance | 1.80E+01 | Resistance | 1.70E+01 | Resistance | 1.70E+01 | Resistance | 2.40E+01 | Resistance | 5.40E+02 | Resistance | 3.40E+01 |
| | Resistivity | 1.44E+02 | Resistivity | 1.36E+02 | Resistivity | 1.36E+02 | Resistivity | 1.92E+02 | Resistivity | 4.32E+03 | Resistivity | 2.72E+02 |

Aging Electrically Induced Combustion

The aging samples were evaluated for electrically induced combustion and extinguishment properties at each aging test interval. The tests were conducted using stainless steel electrodes gapped at ⅛". The electrical source was 60 cycle AC with voltage capability up to 500+ volts. The current was variable, but limited to a maximum of 10 amperes. Combustion tests were performed where the samples were aged at 35 degrees C. to from each of Formulations 1, 2 and 3. On Off cycles at this age were successfully performed, the only significant difference appearing in sample 2. While sample 2 did extinguish readily in the early stages of the aging program, it reached a point where it exhibited a significant drop in combustion rate with drop in voltage, also failed to extinguish when the voltage was turned off.

Propellant Improvements

Figure 4:
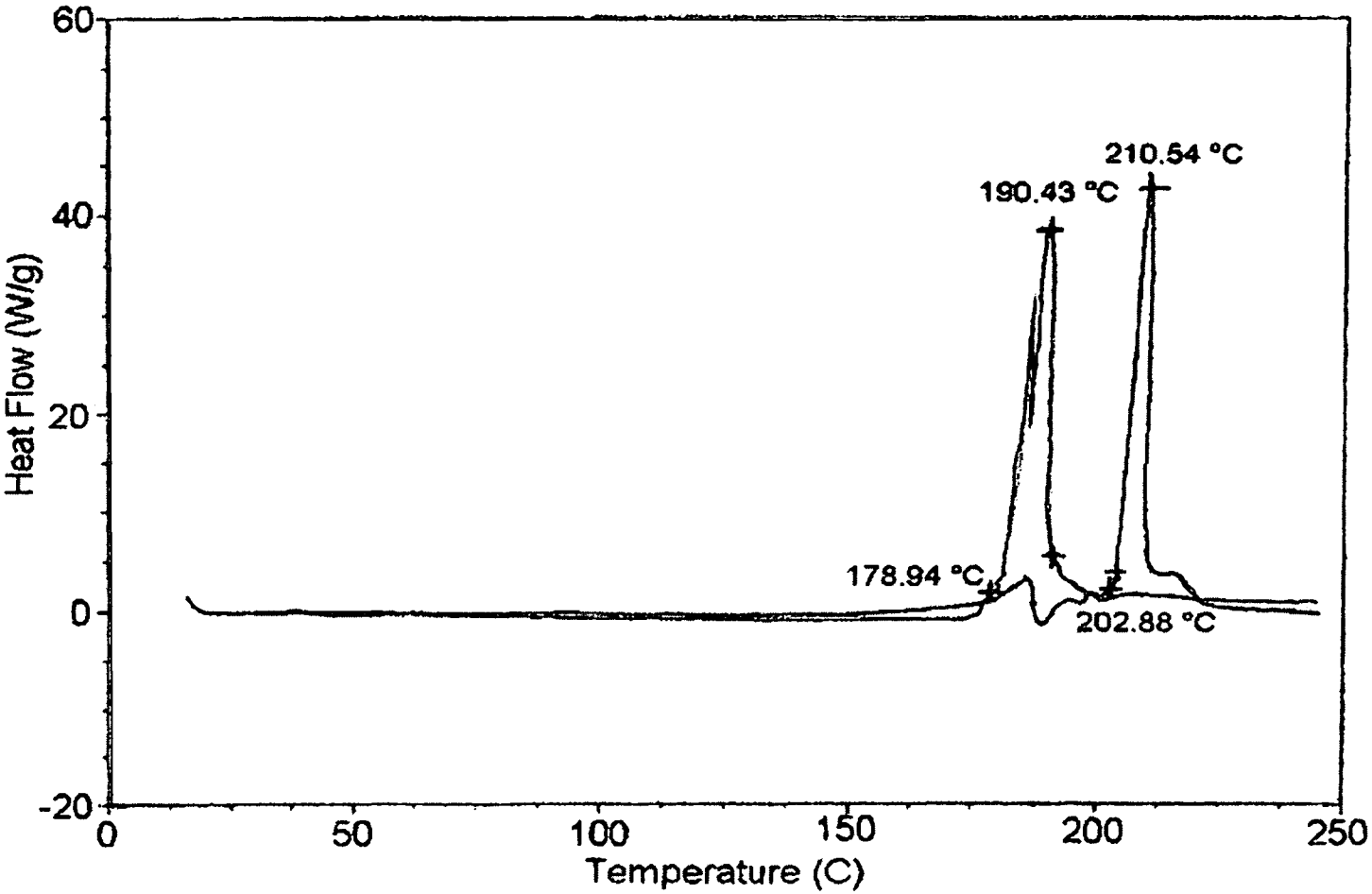
FIG. 4. DSC Scans of HAN/PVA/BORIC ACID Propellants with and without 5-ATZ. (Peaking at 190.43 degrees C., without 5ATZ. Peaking at 210.54 degrees Celsius, with 5 ATZ)

A series of formulations were prepared with 5-aminotetrazole (5ATZ) at various levels. It was used in the hydrated and dried forms (Table 8). There did not appear to be any evidence in the TGA scans that the hydrated 5ATZ behaved differentially from the dried form. Sample #2 appears to be anomalous since it is the same as sample #1, which contains the hydrated 5ATZ. It may be that samples 1 and 2 became switched in the labeling of the scans. In any case, the dried 5ATZ appears to perform well as can be seen in FIG. 4, wherein the peak DSC decomposition exotherm was increased by 20° C. with the addition of 5ATZ.

TABLE 8

HAN/PVA/Boric acid-based propellant formulations with 5ATZ

| | #1 weight % | #2 weight % | #3 weight % | #4 weight % | #5 weight % |
|---|---|---|---|---|---|
| S HAN-5 | 80.0 | 80.0 | 80.0 | 79.0 | 79.5 |
| PVA | 15.0 | 15.0 | 14.0 | 14.0 | 14.0 |
| 5ATZ hydrate | 4.0 | — | — | — | — |
| 5ATZ dried | — | 4.0 | 5.0 | 6.0 | 5.0 |
| $H_3BO_3$ | 1.0 | 1.0 | 1.0 | 1.0 | 1.5 |

The 5ATZ can theoretically affect the propellant in two distinct ways. Since it is amphoteric it can (1) act as a buffer to absorb either acid or base to maintain the proper acidity of the oxidizer and, because it readily forms insoluble complexes with heavy metals it can (2) convert soluble iron and copper in the propellant to insoluble complexes, thereby effectively eliminating their destabilizing effects. That this latter effect takes place was shown indirectly when 5ATZ was added to a propellant that contained dipyridyl which complexes with iron to form an intense red color. When the propellant was placed in a 50° C. oven the red color disappeared after several hours, implying that the 5ATZ removed the iron from the dipyridyl complex. This observation was not confirmed, however.

In this research study we have succeeded in preparing firm, cross-linked HAN/PVA propellants as well as HAN/AN/PVA/PVAN propellants. With PVA as the polymer, only small levels of AN could be used and still achieve a cured tough flexible propellant. The use of PVA/PVAN copolymers made possible the use of higher levels of co-oxidizers with the HAN, which greatly lowers the temperature of crystallization.

In the early samples we demonstrated that propellants, prepared with HAN and PVA polymer, would ignite and extinguish when AC voltage was applied to the surface of the propellant sample and then turned off, respectively. These propellants, however, tended to flow at the burn surface during combustion, making reignition difficult to impossible. Propellants prepared with HAN-based oxidizers and polyacrylamide yielded propellants that did not flow at elevated temperatures (>100° C.). However, these propellants had low room temperature modulii. Propellants prepared with polyacrylamide polymer and HAN oxidizers containing HN, upon curing at 60° C., tended to become tougher, indicating some form of chemical cross-linking between the amine groups of hydrazine and the amide functional groups. These propellants did show signs of gassing over a period of time at elevated temperatures. Tougher propellants were made using the co-polymer PAAm/PAAc (1.5%), which, additionally, showed fewer tendencies to gas. While these polymers, also do not flow at elevated temperatures, the room temperature modulus is less than that of those propellants prepared with PVA polymer. When PVA was combined with PAAm/PAAc, propellants prepared with HAN/AN and HAN/HN formed soft foamy propellants if the oxidizer contained low water levels ~1.0%. Samples prepared with higher levels of water were firmer and showed much less gassing. This was a surprise finding and is not understood at this time.

Although the polyacrylamide/polyacrylic acid polymer, 98.5/1.5, produced firm propellant when HN was formulated into the oxidizer, the propellant still gassed during cure. Because it was speculated that the hardening takes place due to the interchange of the hydrazine with the —$NH_2$ group of the amide to promote cross-linking, it was expected that a free $NH_3$ (ammonia) group was released for each cross-link that took place. Since ammonia is a gas at room temperature, it is believed to be the source of the gassing observed during cure. Attempts to block this by the addition of ammonium bisulfate and polyacrylic acid actually resulted in increased gassing. Substituting ethylene diamine dinitrate (EDDN) for the HN failed to cause significant hardening of the propellant. It was hoped that the ethylene diamine would displace the ammonia groups to cross-link the polymer in the manner that hydrazine was believed to be doing. However, in this case the resulting ammonia groups would have an equivalent amount of nitric acid to keep them in the salt form. Either hydrazine is fairly unique in causing cross-linking by the proposed mechanism, or the mechanism is different from that envisioned. Even the formulations that contained PVA gassed when cured at the elevated temperature. Prolonged curing at 40° C. also caused the PVA containing propellants to become brittle. The cause for this behavior is unknown at this time. What was learned from the high molecular weight polyacrylamide polymers was that cross-linking was not necessary to prevent the resulting propellant from melting at elevated temperatures. The cross-linking is needed solely to increase the propellant modulus and limit the solubility of the polymer in the liquid oxidizer.

The effect of molecular weight on propellant properties was evident on the experiments with PVAN using three different molecular weights. Since PVAN contains a significant amount of useful oxygen, much higher levels of it can be used to prepare HAN-based propellants than is the case for PVA, and still maintain proper oxygen balance. The lowest molecular weight PVAN (~500K) was quite soft and almost gummy. It tended to melt at >100° C. The PVAN having a molecular weight of ~2 M gave a rubbery but sticky propellant. The highest molecular weight PVAN, ~4M, produced a quite strong fairly firm propellant. The propellants made with the two high molecular weight PVAN polymers retained their rubbery characteristics to >100° C., showing no tendency to melt. Propellant made with this high molecular weight PVAN did not gas during cure. Addition of excess AN did improve the physical properties of the propellant, but it was still too soft to be used in the electrical combustion tester. The PVAN could not be cross linked in the presence of HAN because the HAN would react with the butadiene diepoxide (BDDE) cross linking agent and the vinyl functional PVAN failed to cross link using a peroxide initiator. As a consequence, PVAN could not be used as the sole binder in this system at the present time. This system could possibly, however, be used with coated, imbedded electrodes wherein the propellant is not continuously physically forced against a pair of electrodes as combustion takes place.

The use of vinyl-functional PVA/PVAm, 88/12, definitely indicated cross-linking took place when compared to a formulation that did not contain the same polymer without the vinyl functionality. The cross-linking prevented the propellant from melting when heated to >100° C. Although the vinyl-containing propellants were rubbery, they were still too soft to be useful in the intended application, namely for electrically controlled combustion. If the molecular weight of the polymer could be increased from ~100 K to ~500 K, the modulus of the resulting propellant would be appropriate. Short of developing a polymerization scheme that could possibly reach that high molecular weight, we found that the molecular weight of the commercially available copolymer could be significantly enhanced by reacting it with a small enough quantity of difunctional epoxy resin to increase the molecular weight without promoting cross-linking. This discovery permitted HAN to be used in virtually all proportions with AN and HN in a cross-linked propellant formulation that would produce an adequate modulus, thereby greatly increasing the range of compositions that could be prepared. This is important since it was shown that the HAN/PVA propellant cross-linked with boric acid did not burn between electrodes. We suspect that the high electrical conductivity of this propellant allows the electrical current to flow through more of the propellant than just the surface between the electrodes. A reasonably successful burn was demonstrated with the HAN/AN/PVAN wherein the AN was at a high enough level that the ionic liquid to polymer ratio was lowered significantly, thereby increasing the electrical resistivity of the propellant. This increased resistivity is believed to be responsible for causing the bulk of the current flow to take place at the surface. Unfortunately, the mechanical properties of this propellant are also not adequate for the intended application, but may work with imbedded electrodes. With the development of the high molecular weight copolymer, though, it is now possible to prepare a similar propellant that can be cross-linked and has the desired mechanical properties.

It seems fairly certain that high electrical conductivity in the propellant is not desirable. The electrical resistance of the propellant has to be high enough to force the bulk of the electrical current to take the shortest path between electrodes. Because such a propellant was demonstrated using the PVAN polymer, it now appears very possible using the high molecular weight copolymer of PVA/PVAN to tailor propellants to produce the desired electrical response while providing the needed mechanical properties and the high temperature dimensional stability. The added advantage is room temperature processing and good electrical conductivity to temperatures possibly as low as −20° C.

Since a good pathway was found to prepare the desired propellants, work on preparing vinyl functional polymers was terminated. The experience with that system was not very positive. The work needed to prepare and understand such a system is beyond the scope of this study. It is not as straightforward as was originally envisioned.

When boric acid was added to the formulation as a fine granulated solid, it did not influence the process and cast characteristics of the propellant to any significant extent. However, when the boric acid was predissolved in the HAN oxidizer, it thickened the propellant immediately during processing, making it thixotropic. However, if the propellant ingredients are cooled to 15-20° C. there is no immediate thickening. Boric anhydride also works similarly to boric acid, but takes longer to interact since it has to convert to boric acid by reaction with the moisture in the propellant first.

As an alternative, it was felt that the PVA/PVAN copolymer would be more amenable to preparing propellant with adequate rigidity because it can be cross linked through the PVA portion with boric acid and the PVAN portion makes the polymer more compatible with AN than does PVA. The molecular weight had to be increased, though, to accomplish this. Preparation of the molecular weight enhanced copolymer appeared to proceed better when carried out in solution than as a polymer slurry. The solution approach will probably prove to be the correct way to proceed. The purpose of preparing this enhanced copolymer originally was to permit the formulation of propellant with sufficient excess AN that it would stay as a solid rather than dissolve into the HAN and become a liquid. Once the AN content of a HAN/AN mixture exceeds 25%, no more AN can be dissolved. This approach would increase the electrical resistivity of the propellant because it would lower the liquid oxidizer content. However, we discovered that using a ⅛" or less gap between electrodes enabled the HAN based propellant to be electrically initiated and burned without having granular AN in the formulation. Such a gap forces the bulk of the electrical current to flow from electrode to electrode essentially along the surface of the propellant rather than into the body of the propellant as was observed with larger gaps. The other reason to prepare this polymer is to permit the use of AN and HN in the formulation to provide propellants that can operate at very low temperatures.

The aging results to date indicate that formulation #1 is clearly the best overall. It has hardly changed any of its properties from those initially measured and has functioned the most consistently during the combustion and extinguishments tests. Although formulation #2 started out quite well, it soon became more and more difficult for it to extinguish. Eventually, it refused to extinguish at all even though it burned faster when current was applied than it burned after the current was turned off. Also, this formulation exhibited signs of decomposition after several months at 50° C. The change at 35° C. was much slower, as one would expect. Of course, these physical changes affected the Torsional modulus, but didn't seem to have much effect on the DSC and TGA scans. Since formulation #2 differed from formulation #1 by the addition of sodium nitrate, one has to conclude that this material was responsible for the changes observed. It is difficult to understand how sodium nitrate can cause this change except to believe that, since the nitrate ion is present as the main anion in the formulation, the sodium ion must be promoting the decomposition of hydroxylamine, resulting in the release of nitric acid. When the nitric acid level exceeds the buffer level the propellant begins to exhibit decomposition. Formulation #3 behaved very much like formulation #1 except that its physical properties initially were not as good due to the inadequacy of the epoxy-enhanced molecular weight of the commercial copolymer. This aging was conducted before the molecular weight enhancement of the commercial copolymer was conducted. Formulation #3 exhibited the best combustion properties without compromising the extinguishment properties. It also aged well; giving more credence to the conclusion that sodium nitrate is causing the aging problems in Formulation #2. The improved combustion properties have to be attributed to the PVAN content.

The polymer used for Formulation #3 is compatible with the higher level of ammonium nitrate. PVA is not compatible with this higher level and would not cure with the oxidizer composition used for Formulation #3. The problem with the polymer used in Formulation #3, however, is that it did not confer the desired physical properties on the propellant made with it. This is first due to the fact that the unaltered polymer has too low a molecular weight to begin with and secondly the use of boric acid to cross-link the polymer in the propellant does not appear to compensate totally for the low molecular weight. Thirdly, the chemical modification with the epoxy resin BDDE effectively increases the molecular weight, but also causes sufficient cross-linking to take place that the propellant made with it does not possess the desired physical properties. An alternate source of the copolymer was identified from Mitsubishi Chemical. The copolymer provided by Mitsubishi is significantly higher in molecular weight (117,000 vs. 80,000) than that provided by ERKOL and has a higher titratable amine content (12% vs. 9%). It produces a higher modulus propellant without molecular weight enhancement with BDDE. It is expected that with molecular weight enhancement this copolymer will produce propellant with greatly improved tangent modulus.

Because we have demonstrated that this class of electrically controlled propellant has a very low resistivity, we believe that to be the reason for the difficulty in initiating combustion with electrode gaps greater the ⅛". The lower resistivity permits the current to travel throughout the propellant body and not just along the surface. By closing the electrode gap the current does not have the opportunity to penetrate very deeply into the surface before encountering the other electrode. This allows the bulk of the current to flow along the surface thereby readily causing ignition. By preparing ⅛" thick segments of this propellant and separating them with very thin spacers one can form a multi-segment propellant grain, the ends of which will have the non-conducting film. The electrodes can then be put at the ends of the grain such that conduction can only take place along the top surface of the sandwich. This permits a relatively large propellant span between electrodes while limiting the penetration of the current into the propellant grain. The separators burn away along with the propellant. An alternative is to imbed coated-closely spaced electrodes in the propellant. The electrodes would be polarized alternatively positive and negative so that current would not have to flow very far between electrode set to cause combustion.

In one example, this propellant has exhibited the ability to extinguish at ~350 psi and could be ignited at low voltages. However, subsequent tests indicated that 150 psi was an upper pressure limit for extinguishment. By tailoring the testing setup to the propellant it will be possible to realize the good properties of this propellant without overly compromising its greater energy content.

This technology is seen to have a broad application as an alternative to propulsion systems currently employing liquid propulsion systems and future systems being evaluated for the use of hybrid, liquid or gelled monopropellants. The simplicity and precise thrust controller offered by the ECESP may be critical to formation flying of future microsatellite arrays and their rapid re-tasking. The digital solid-state propulsion technology could also be used to produce a divert and attitude control system (DACS) with no moving parts, which should be ideal for tactical missile application.

Another emerging application for this propulsion technology is airships operating at high altitude or near space (~100,000 ft.). Propeller propulsion while possible at these altitudes is slow to react and inefficient, while more efficient space propulsion (ion engines) cannot operate at high atmospheric backpressures at <250,000 ft. ECESP could provide these next generation high altitude airships with safe ground/shipboard handling (unlike hydrazine) and controlled on demand thrust for emergency propulsion maneuvers.

These propellants appear very attractive as solid-state on-demand gas generators. These solid-sate gas generators should be "nearly" drop in replacements for some existing cold and warm gas propulsion units. The disclosed electrically controlled solid propellant combined with commercially available micro-solenoid values appear to provide a the basis for a versatile, low cost unified warm gas thruster module, with on-demand tank re-pressurizations. Commercially available micro solenoids are currently specifying minimum impulse bits down to 44 mN seconds and this can be provided by the disclosed propellant. The propellant mass fraction in an example of a complete system weighing approximately 500 grams and having a 400N-sec total impulse, unified 6-axis ACS thrust is around 40% with an overall combustion chamber aspect ratio of six. Higher case/combustion chamber aspect ratios would yield somewhat higher propellant mass fractions. Table 2b compares the notional thruster with the highly maneuverable SPHERES nanosatellite cold gas thruster.

We are currently applying our controllable solid propellant technology to developing motor and low cost controller technology to a dual-stage tactical rocket motors, in smart automotive airbags, and as an emergency ballast blow/purge system for submarines, replacing the typical all or nothing emergency gas generation ballasts with one that is more controllable.

Additionally, the electrode design proposed here is very compatible with standard semiconductor (layered) manufacturing. This manufacturing compatibility provides another potential very large application that may be much faster to market, which is the use of the ECESP as a gas generator for microactuators in MEMS. Using the disclosed propellants for on demand gas generation may be highly effective in enabling a whole new class pneumatically powered nano-robotic devices, as well as their large cousins.

One skilled in the art will appreciate that the present invention can be practiced by other than the preferred embodiments, which are presented for purposes of illustration and not of limitation. Therefore, the foregoing is considered as illustrative only of the principles of the invention.

We claim:

1. A method of controlling a propellant, the method comprising the steps of:

a. providing an electrically controlled propellant comprising:
   i. a binder
   ii. a hydroxylamine nitrate (HAN) based oxidizer;
   iii. a dipyridyl complexing agent; and
b. cross-linking said binder with a boric acid cross-linking agent;
c. igniting said propellant by applying an electrical voltage; and
d. extinguishing said propellant by withdrawing said electrical voltage.

2. The method of claim 1 further comprising the step of increasing the decomposition temperature of said propellant through the use of a 5-aminotetrazole stabilizer.

3. The method of claim 1 wherein said binder is a copolymer of PVA/PVAN.

4. The method of claim 3 further comprising the step of increasing the decomposition temperature of said propellant through the use of a 5-aminotetrazole stabilizer.

5. The method of claim 3 wherein said copolymer primarily comprises PVA.

6. The method of claim 5 further comprising the step of dissolving said boric acid cross-linking agent in said HAN based oxidizer.

7. The method of claim 6 further comprising the step of increasing the decomposition temperature of said propellant through the use of a 5-aminotetrazole stabilizer.

* * * * *